US005116049A

United States Patent [19]

Sludikoff et al.

[11] Patent Number: 5,116,049

[45] Date of Patent: May 26, 1992

[54] LOTTERY GAME SYSTEM AND METHOD OF PLAYING

[76] Inventors: Stanley R. Sludikoff, 17437 Tarzana St., Encino, Calif. 91316; Carl Alexoff, 539 Tarrington Ct., Cherry Hill, N.J. 08034

[21] Appl. No.: 766,075

[22] Filed: Sep. 27, 1991

[51] Int. Cl.[5] ..... A63F 3/06

[52] U.S. Cl. ..... 273/139; 283/903

[58] Field of Search ..... 273/138 R, 139, 148 R; 283/901, 903

[56] References Cited

U.S. PATENT DOCUMENTS 4,688,797 8/1987 Sebestyen ..... 273/148 R 4,871,172 10/1989 Hwang ..... 273/138 R

FOREIGN PATENT DOCUMENTS 494948 4/1977 Australia ..... 283/903

OTHER PUBLICATIONS

Virginia Lottery Pick 3 Play Slip and Rules.

*Primary Examiner*—Benjamin Layno

*Attorney, Agent, or Firm*—Shlesinger Arkwright & Garvey

[57] ABSTRACT

The lottery game is played by selecting a plurality of multiple digit rows of numbers each row is offset from the preceding row. The game is played by matching according to a lottery sponsored drawing sets of the selected numbers. A winning ticket is obtained when the drawn numbers are matched to those on the ticket in a consecutive manner either across or down matching all of the numbers across produces a jackpot winner. Matching some of the numbers either across or down also produces a prize winning ticket.

8 Claims, 2 Drawing Sheets

TICKET
NOV DEC 90
262728293001 02
9 3 4 7 8 6 0
MON
FRI NOV23 90
1000000 000000000 $ 1.00
0040000 001 70000000 000 000

TICKET
NOV DEC 90
2324252627282930010203
9 3 4 7 8 6 0
FRI
SAT
SUN
MON
TUE
FRI NOV23 90
0020007 0000400000 $ 5.00
0040000 000 00000000 000 000

TICKET
NOV DEC 90
2324252627282930010203040 5
9 3 4 7 8 6 0
FRI
SAT
SUN
MON
TUE
WED
THU
FRI NOV23 90
0000004 0000000000 $ 7.00
0000000 100 00000000 400 001

LOTTERY GAME SYSTEM AND METHOD OF PLAYING

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

FIELD OF THE INVENTION

This invention is directed to a lottery game in which numbers are selected and recorded and then matched against a number set produced after the initial selection and recordation.

BACKGROUND OF THE INVENTION

The evolution of lottery games has evolved from the original passive draw-type lottery to instant winning games and then on to pick three and pick four games and then to lotto jackpot type games. The passive draw-type game included a purchase of a prenumbered ticket. These tickets were generally sold in ascending numerical order and after a certain period of time a winning number of one of the tickets sold was selected and the prize was awarded to the holder of the ticket bearing the winning number.

Instant winning games were introduced in 1974 which generally included some kind of scratch-off game where a number or a certain number of items were matched according to a predetermined winning scheme.

Next, the pick your own number games were introduced which included the pick three game, the pick four game and the lotto jackpot game. In the pick three and pick four games, three or four numbers, respectively are chosen and must be matched in consecutive order with the winning number produced by the lottery operator.

The jackpot lotto game is played by picking generally six numbers of a selected set such as from 1 to 50. The six numbers may be selected by a computer or may be selected by the player and generally with the long odds of winning on the game, no particular order of numbers is required. The winning numbers are generally selected from a box containing ping pong balls numbered from 1 to 50, for example.

The players of these lottery games prefer the better odds of winning available from the pick three and pick four games, but on the other hand, the large jackpots are only available in the lotto games which have extremely long odds. The factors of the foregoing games have lead to a general decline in their popularity.

In view of the foregoing it can be seen that there is a need for a new lotto game which incorporates the "believe I can win feeling" of small odds games, added to the lottomania excitement of large jackpots.

OBJECTS AND SUMMARY OF THE INVENTION

It is an object of the invention to provide a game design which includes a multiplicity of games with different odds and prize structures.

It is also an object of the invention to integrate all pick your own number type games into a single game.

Still another object of the invention is to provide a new lottery game which will operate on existing on-line equipment.

Yet another object of the invention is to provide a game which combines the frequency of daily prize awards with the excitement of daily drawings plus the potential of future winnings.

In summary, therefore, this invention is directed to a game having a ticket with a plurality of rows and columns of numbers whereby winning is accomplished by matching numbers in consecutive order with a number drawn by the lottery sponsor. A winning ticket is obtained when the drawn numbers are matched to those on the ticket in a consecutive manner either across or down. The requirement for consecutive matching reduces the amount of numbers required for a selection.

DETAILED DESCRIPTION OF THE INVENTION

The invention is directed to a lottery game in which the players' wagers are placed in a common pool and divided among them and the lottery sponsor in accordance with their own selections and the rules of the game.

Preferably, the game is played over seven consecutive days, with one number set being drawn each day. In addition, a new game is begun each day, which is linked to as many as six previous and/or subsequent games. Preferably, each set includes seven numbers. A given number will occur only once in each set. To win the top prize, one must match the seven numbers drawn in exact order.

Figures 1, 2, 3:
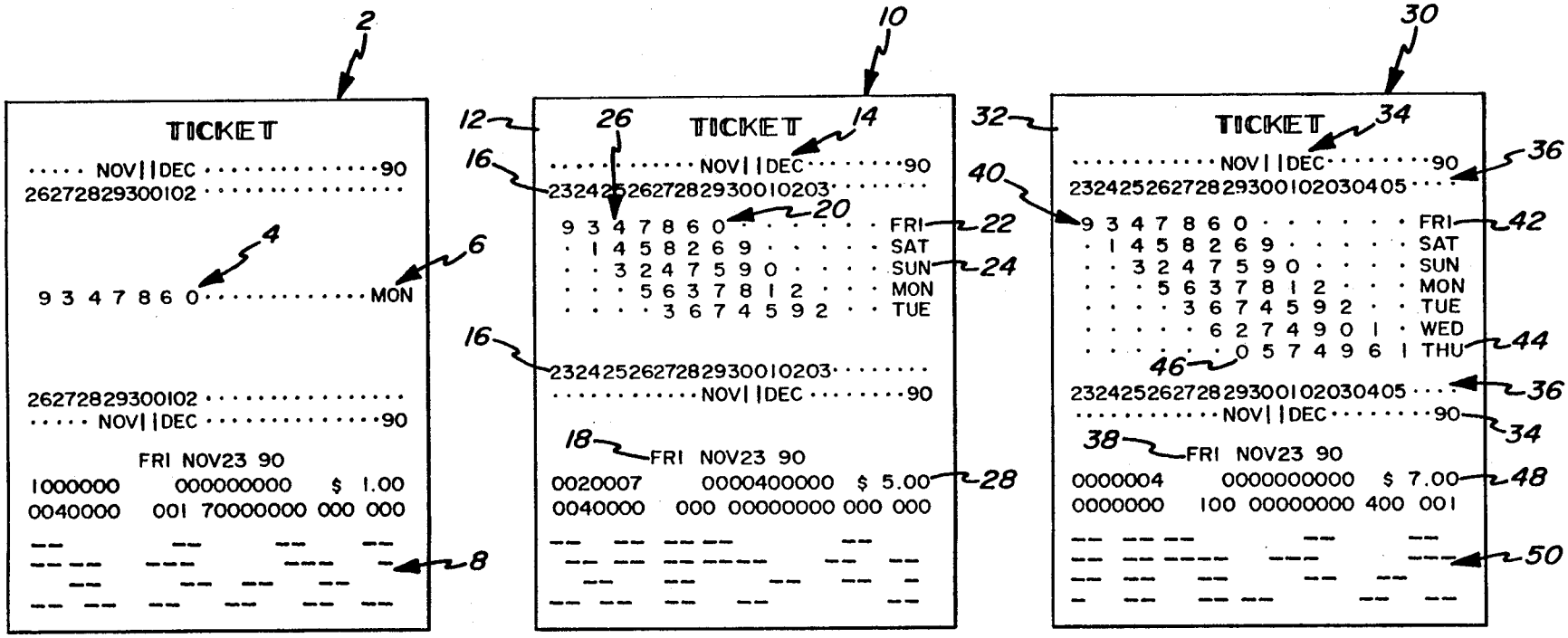
FIG. 1 is a sample ticket for a one game drawing.
FIG. 2 is a sample ticket for a five consecutive game drawing.
FIG. 3 is a sample ticket of a seven consecutive game drawing.

The invention will be further described with reference to the drawing figures. FIG. 1 shows a sample ticket 2 having a number selection 4 beginning on a designated day 6 (Monday in this instance). Codes 8 prevent counterfeiting of the ticket 2.

Prizes can be won by matching the seven digits in exact order. Matching three or four or five or six of the numbers in consecutive order will also produce a prize winning ticket. The game begun with this ticket can be played for seven days by matching in consecutive order the first number of each drawing for seven consecutive days beginning on Monday. Again, matching three or four or five or six of the numbers will also produce a prize. This way the player's interest is kept for seven days.

FIG. 2 shows a sample five-game ticket 10 for use in a game started on five consecutive days, Friday-Tuesday. Seven numbers for each game are chosen and printed on the ticket face 12. The ticket face 12 indicates the dates of the drawings extend from November into December by designation Nov/Dec 14, and a date line 16, top and bottom, and the sale date 18. Matching the seven numbers 20 on the Friday row 22 drawn by the lottery sponsor will provide a winning ticket. The numbers must be matched in the exact order, i.e. 9347860. Matching three or four or five or six of the numbers will also produce a prize. Due to possible matching of vertical numbers, the ticket provides additional chances to win on the third through ninth days. Due to the staggered start the ticket is in play for eleven days.

A separate drawing of seven numbers will be commenced each following day, Saturday, Sunday, Monday and Tuesday.

After the third day's drawings, the player can begin to match numbers vertically. On Sunday in ticket 10, the player can match three numbers in the vertical column 26: 443. The player could also match 934 across by taking the first number of each day's drawing. After Monday's drawing, multiple ways to win become more evident. The player can match 752 or 525 in a vertical direction, or 347 on the top line or 145 on the second line. In addition to the pick three numbers previously described, the opportunity to win on a pick four game also arises with the choices being 7525 in the vertical direction, and 9347 in the horizontal row. On Tuesday additional pick three horizontal choices of 478, 458 and 324 on the top, second and third rows, and additional vertical choices of 884, 846 and 463 become available. In addition pick four choices of 3478 and 1458 become available on the top and second rows, while vertical pick four choices of 8846 and 8463 become available. Additional pick five choices of 93478 horizontally and 88463 vertically become available. On Wednesday the following additional choices become available: pick three horizontally—786, 582, 247, 563; pick four horizontally 4786, 4582 and 3247; pick five horizontally—34786 and 14582; and pick six horizontally 934786. Vertically, additional pick three choices are 627, 273 and 736; pick four choices are 6273 and 2736, and a vertical pick five of 62736.

On Thursday the following additional choices become available: pick three horizontally—860, 826, 475, 637 and 367; pick four horizontally—7860, 5826, 2475 and 5637; pick five horizontally—47860, 45826 and 32475; pick six horizontally—347860 and 145826; and pick seven horizontally—9347860. Vertically, additional pick three choices are—065, 657 and 577; pick four choices are 0657 and 6577; and pick five of 06577.

On Friday the following additional choices become available: pick three horizontally—269, 759, 378 and 674; pick four horizontally—8629, 4759, 6378 and 3674; pick five horizontally—58269, 24759 and 56378; pick six horizontally—458269 and 324759; and pick seven horizontally—1458269. Vertically, additional pick three choices are—998 and 984; and pick four choice of 9984.

On Saturday the following additional choices become available: pick three horizontally—590, 781 and 745; pick four horizontally —7590, 3781 and 6745; pick five horizontally—47590, 63781 and 36745; pick six horizontally—247590 and 563781; and pick seven horizontally—3247590. Vertically, an additional pick three of 015 is the last available choice.

On Sunday the following additional choices become available: pick three horizontal—812 and 459; pick four horizontal—7812 and 7459; pick five horizontal 37812 and 67459; pick six horizontal—637812 and 367459; and pick seven horizontal—5637812.

On Monday the following additional choices become available: pick three horizontal—592; pick four horizontal—4592; pick five horizontal—74592; pick six horizontal 674592; and pick seven horizontal 3674592. The charge 28 for the ticket is preferably coincident with or a multiple of the number of days played.

Preferably, the payoff would be in accordance with the largest winning prize in a line, however, multiple prizes may be available from one ticket wherein prizes may be won on consecutive days by matching either horizontally or vertically.

As shown in FIG. 3, the ticket 30 has a front face 32 indicating the month and year 34, a date line 36 and the date of purchase 38. The game can and preferably is played with a seven day card wherein the rows 40 of seven horizontal beginning with a Friday row 42 and ending with a Thursday row 44. The lines of numbers are staggered so that along with the seven horizontal jackpot chances, there will also be one vertical jackpot chance 46. The charge 48 for the ticket is also preferably shown on the front face. A bar code and other numbers 50 provide additional security to prevent counterfeiting.

On a seven day ticket 30, counting all of the possible pick three, pick four, pick five, pick six and seven number matches, there exists a total of fifteen ways to win on each horizontal line for a total of one hundred and five ways to win in the across direction. Adding to that amount, this the possible winners in the vertical direction of fifty five ways to win going down, there are a total of one hundred and sixty ways to win on one seven day card.

The three tickets 2, 10 and 30 indicate the purchase date of Friday, November 23. It is not necessary to start playing the game on the day the ticket is purchased. The player can defer the beginning of the game up to a week from the purchase date.

As previously stated, prizes are awarded for consecutively matching in the horizontal direction seven across, six across, five across, four across and three across. At the option of the lottery sponsor, prizes may also be offered for matching two across. Prizes are also awarded for matching seven down vertically, six down, five down, four down and three down. At the option of the lottery sponsor, prizes may be offered for matching two down. Winners of the largest prizes for consecutive vertical matches are determined each day, while winners of the largest number of consecutive matches across can only be determined after seven days of drawings. One seven across winner will be determined every day. With winners being determined only by a minimum of three across or down, a seven day ticket 30 as shown in FIG. 3 can win as many as sixteen prizes with as many as one hundred and sixty possible ways to win. By allowing matches of two across and down, one seven day ticket can win as many as eighteen prizes with as many as two hundred and thirty eight possible ways to win. The following Table I illustrates the number of prizes as well as the total ways to win in a seven game ticket.

TABLE I

| | | |
|---|---|---|
| 1 2 3 4 5 6 7 * * * * * * | SAT | --{ [1]-15 WAYS TO WIN ON THIS LINE |
| * 1 2 3 4 5 6 7 * * * * * | SUN | --{ [2]-15 WAYS TO WIN ON THIS LINE |
| * * 1 2 3 4 5 6 7 * * * * | MON | --{ [3]-15 WAYS TO WIN ON THIS LINE |
| * * * 1 2 3 4 5 6 7 * * * | TUE | --{ [4]-15 WAYS TO WIN ON THIS LINE |
| * * * * 1 2 3 4 5 6 7 * * | WED | --{ [5]-15 WAYS TO WIN ON THIS LINE |
| * * * * * 1 2 3 4 5 6 7 * | THU | --{ [6]-15 WAYS TO WIN ON THIS LINE |

TABLE I-continued

```
* * * * * * 1 2 3 4 5 6 7 FRI  - - {  [7]-15 WAYS TO WIN ON THIS LINE
  | | | | | | | | |                 105 TOTAL WAYS TO WIN-ACROSS

| | | | | | | | + - - - - - - - - - -   {  [8]- 1 WAY TO WIN ON THIS LINE
| | | | | | | + - - - - - - - - - -     {  [9]- 3 WAYS TO WIN ON THIS LINE
| | | | | | + - - - - - - - - - - -     { [10]- 6 WAYS TO WIN ON THIS LINE
| | | | | + - - - - - - - - - - - -     { [11]-10 WAYS TO WIN ON THIS LINE
| | | | + - - - - - - - - - - - - -     { [12]-15 WAYS TO WIN ON THIS LINE

  | | | + - - - - - - - - - - - - - - - - - { [13]-10 WAYS TO WIN ON THIS LINE
  | | + - - - - - - - - - - - - - - - - - - { [14]- 6 WAYS TO WIN ON THIS LINE
  | + - - - - - - - - - - - - - - - - - - - { [15]- 3 WAYS TO WIN ON THIS LINE
  + - - - - - - - - - - - - - - - - - - - - { [16]- 1 WAY TO WIN ON THIS LINE
                                            55 TOTAL WAYS TO WIN-DOWN
                THERE ARE - - - 160 TOTAL WAYS TO WIN
```

Figure 4:
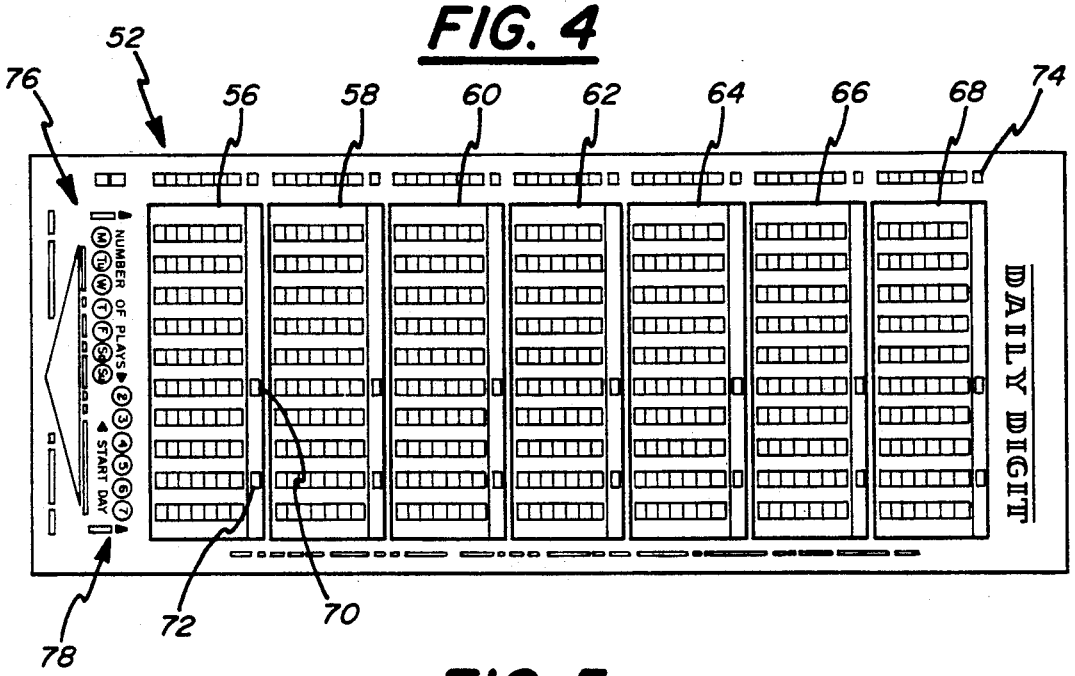
FIG. 4 is an illustration of a sample playslip.
Figure 5:
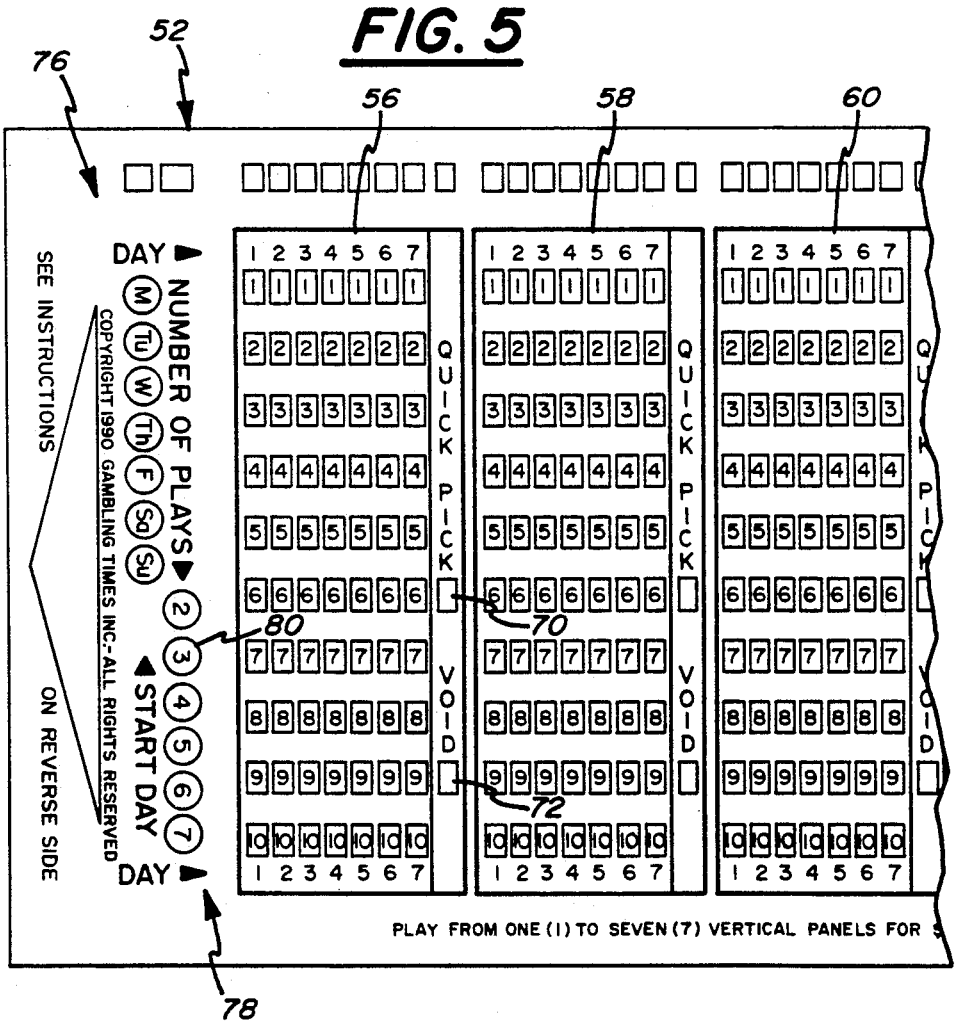
FIG. 5 is an enlarged fragmentary view of the playslip of FIG. 4.

The playslip 52 for selecting the numbers and tickets as shown in FIGS. 4 and 5 is designed to work with existing terminals used in playing lotto. The playslip 52 may be made for variations to be played with eight or up to fifteen balls in the random number generator. Each playslip 52 preferably includes a series of seven boxes 56, 58, 60, 62, 64, 66 and 68 having seven vertical columns of the total number of balls used in the game. The seven vertical columns represent the order in which numbers will be drawn. The player should select one number out of each column, with no two numbers being the same to obtain the first horizontal row of numbers. The numbers are selected by blackening the appropriate boxes as shown in FIG. 5. The player can elect a quick pick 70 which is a machine drawn number, and if the player makes an error in the selection process a void 72 is selected. The playslip includes a line of initializing codes 74 along one edge which initializes the playslip reader (not shown) to automatically read the playslip after numbers have been selected. One end of the playslip includes boxes which indicate the start day 76 and the number of plays selected 78 for the game on the same day. Blackening of these boxes indicates these selections to the computer which then prints out the ticket such as shown in FIGS. 1, 2 or 3 which is retained for playing the game.

Preferably, no more than two games may start on the same day in each ticket. Therefore, if box 80 is selected in line 78, then the player will receive one ticket having two games and another ticket with one game thereon, all starting on the same day. This prevents the possibility of someone having a seven by seven block of numbers and having a jackpot chance every day and a possibility of eight jackpots on the last day.

The precise manner in which the prize pool is allocated can be tailored to meet the objectives of the lottery sponsor. This allocation is related to the odds in the game and would vary in accordance with the prize category selected and the number of balls in the game.

Rollover jackpots add interest, excitement and participation to any lottery game. With the present invention there are eight possible jackpots on a seven day ticket that could roll over. Each day's game played over a seven day period could end in a roll over. The seven down game, played on the seventh day of the seven day ticket is very likely to roll over, due to the long odds for a winner. It is possible that the down jackpot could be rolled over to the immediate next game while the across jackpot could be rolled to the game starting the next day. Thus the Monday game jackpot will be rolled to the next Monday. The larger down jackpot may take several days to be hit and could even roll over for a week or more, this will encourage considerable activity due to the large amount which could be won.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

We claim:

1. A method of playing a lottery game, said method comprising the steps of:

a) selecting numbers for a series of rows to create a plurality of rows and at least one column of numbers;

b) printing a ticket having said series of rows of numbers including at least a first row and a succeeding row wherein the succeeding row is located below said first row and offset at least one number, said series of rows forming at least one column of numbers where said rows overlap; and, c) matching at least some of said numbers from either a row or a column with a second drawn set of numbers.

2. The method as set forth in claim 1, wherein;

a) the step of matching at least some of said numbers includes matching said numbers in consecutive order.

3. The method as set forth in claim 1, wherein:

a) selecting numbers for each of said rows includes selecting a plurality of numbers, each being different from the other and said numbers being selected from a defined group.

4. The method as set forth in claim 1, wherein:

a) matching at least some of said numbers includes matching seven numbers from either a row or a column will win a prize.

5. The method as set forth in claim 1, wherein:

a) matching at least three of said numbers in either a row or a column produces a winning ticket.

6. The method as set forth in claim 1, further comprising:

a) awarding of prizes based upon the amount of consecutive numbers matched between the ticket numbers and said second drawn set of numbers.

7. A ticket for playing a lottery game in which a winning set of numbers is randomly selected after a ticket purchasing period has expired, said ticket comprising:

a) a substrate having a front and a back;

b) said front having indicia thereon in the form of a first row of evenly spaced apart numbers followed by succeeding rows of numbers located beneath said first row said succeeding rows of numbers each also having evenly spaced apart numbers, each said succeeding row of numbers being laterally offset rom each proceeding row of numbers by at least one number;

c) columns of numbers are formed vertically by overlapping numbers between said first row and said succeeding rows; and, d) whereby the game is played by consecutively matching at least one of said rows and columns to at least a portion of said winning set.

8. The ticket as set forth in claim 7, wherein:

a) said indicia includes seven rows of seven numbers;

b) each of said succeeding rows is offset from the preceding row by one number so that one column of seven numbers is formed.

* * * * *

UNITED STATES PATENT AND TRADEMARK OFFICE
CERTIFICATE OF CORRECTION

PATENT NO. : 5,116,049

DATED : May 26, 1992

INVENTOR(S) : Stanley R. Sludikoff & Carl Alexoff

It is certified that error appears in the above-identified patent and that said Letters Patent is hereby corrected as shown below:

In cols. 3, 4, 5 and 6, Table I should be deleted and substitute therefore the attached sheet consisting of Table I.

UNITED STATES PATENT AND TRADEMARK OFFICE
CERTIFICATE OF CORRECTION

PATENT NO. : 5,116,049

DATED : May 26, 1992

INVENTOR(S) : Stanley R. Sludikoff & Carl Alexoff

It is certified that error appears in the above-identified patent and that said Letters Patent is hereby corrected as shown below:

TABLE I

```
1 2 3 4 5 6 7 * * * * * * SAT --{  [1]-15 WAYS TO WIN ON THIS LINE
* 1 2 3 4 5 6 7 * * * * * SUN --{  [2]-15 WAYS TO WIN ON THIS LINE
* * 1 2 3 4 5 6 7 * * * * MON --{  [3]-15 WAYS TO WIN ON THIS LINE
* * * 1 2 3 4 5 6 7 * * * TUE --{  [4]-15 WAYS TO WIN ON THIS LINE
* * * * 1 2 3 4 5 6 7 * * WED --{  [5]-15 WAYS TO WIN ON THIS LINE
* * * * * 1 2 3 4 5 6 7 * THU --{  [6]-15 WAYS TO WIN ON THIS LINE
* * * * * * 1 2 3 4 5 6 7 FRI --{  [7]-15 WAYS TO WIN ON THIS LINE

                                 105 TOTAL WAYS TO WIN-ACROSS

                      +-----------{  [8]- 1 WAY TO WIN ON THIS LINE
                    +-------------{  [9]- 3 WAYS TO WIN ON THIS LINE
                  +---------------{ [10]- 6 WAYS TO WIN ON THIS LINE
                +-----------------{ [11]-10 WAYS TO WIN ON THIS LINE
              +-------------------{ [12]-15 WAYS TO WIN ON THIS LINE
            +---------------------{ [13]-10 WAYS TO WIN ON THIS LINE
          +-----------------------{ [14]- 6 WAYS TO WIN ON THIS LINE
        +-------------------------{ [15]- 3 WAYS TO WIN ON THIS LINE
      + -------------------------{ [16]- 1 WAY TO WIN ON THIS LINE

                                 55 TOTAL WAYS TO WIN-DOWN

                THERE ARE --- 160 TOTAL WAYS TO WIN
```

Signed and Sealed this

Twentieth Day of July, 1993

*Attest:*

*Attesting Officer*

Michael K. Kirk

MICHAEL K. KIRK

*Acting Commissioner of Patents and Trademarks*